US012774667B2

(12) United States Patent
Santini et al.

(10) Patent No.: US 12,774,667 B2
(45) Date of Patent: Oct. 27, 2026

(54) COMBINED HEAT RECOVERY AND CHILLING SYSTEM AND METHOD

(71) Applicant: Nuovo Pignone Tecnologie—S.r.l., Florence (IT)

(72) Inventors: Marco Santini, Florence (IT); Simone Amidei, Florence (IT)

(73) Assignee: Nuovo Pignone Tecnologie S.R.L., Florence (IT)

( * ) Notice: Subject to any disclaimer, the term of this patent is extended or adjusted under 35 U.S.C. 154(b) by 324 days.

(21) Appl. No.: 16/640,968

(22) PCT Filed: Aug. 22, 2018

(86) PCT No.: PCT/EP2018/072695
§ 371 (c)(1),
(2) Date: Feb. 21, 2020

(87) PCT Pub. No.: WO2019/042847
PCT Pub. Date: Mar. 7, 2019

(65) Prior Publication Data

US 2020/0191021 A1 Jun. 18, 2020

(30) Foreign Application Priority Data

Aug. 29, 2017 (IT) ..... 102017000096779

(51) Int. Cl.
*F01K 15/00* (2006.01)
*F01K 13/02* (2006.01)
(Continued)

(52) U.S. Cl.
CPC ..... *F01K 15/00* (2013.01); *F01K 13/02* (2013.01); *F01K 17/005* (2013.01); *F01K 23/10* (2013.01);
(Continued)

(58) Field of Classification Search
CPC ..... F01K 23/10; F01K 17/005; F01K 17/02; F01K 17/025; F01K 15/00; F01K 25/08;
(Continued)

(56) References Cited

U.S. PATENT DOCUMENTS 4,905,481 A * 3/1990 Scaringe ..... C09K 5/044 62/500
5,321,944 A * 6/1994 Bronicki ..... F04D 29/5826 60/775
(Continued)

FOREIGN PATENT DOCUMENTS

CN 107270578 A * 10/2017
JP 54042057 A * 4/1979
(Continued)

OTHER PUBLICATIONS

International Search Report of the International Searching Authority for PCT/EP2018/072695 with mailing date of Sep. 21, 2018.

*Primary Examiner* — Jesse S Bogue
(74) *Attorney, Agent, or Firm* — Paul Frank + Collins P.C.

(57) ABSTRACT

A new combined thermodynamic system (101) uses waste heat from an exhaust combustion gas of a prime mover (162) to produce mechanical power that operates a refrigeration circuit (105). The refrigeration circuit can cool air ingested by the prime mover to improve its power rate and/or efficiency. The system comprises a power generation circuit (103) adapted to circulate a first flow of a working fluid and produce mechanical power therewith. The combined thermodynamic system (1) further comprises a refrigeration circuit (105) comprising a refrigerant compressor (117) driven by mechanical power generated by the power generation circuit (103) and adapted to circulate a second flow of said working fluid in the refrigeration circuit (105).

14 Claims, 6 Drawing Sheets

(51) Int. Cl.

| | |
|---|---|
| ***F01K 17/00*** | (2006.01) |
| ***F01K 23/10*** | (2006.01) |
| ***F01K 25/10*** | (2006.01) |
| ***F25B 11/02*** | (2006.01) |
| ***F25B 11/04*** | (2006.01) |

(52) U.S. Cl.
CPC ..... *F01K 25/10* (2013.01); *F25B 11/02* (2013.01); *F25B 11/04* (2013.01); *F25B 2400/14* (2013.01)

(58) Field of Classification Search
CPC ..... F01K 25/10; F01K 13/00; F01K 13/02; F01K 23/00; F01K 23/02; F01K 23/04; F01K 23/07; F01K 23/08; F01K 23/12; F01K 23/13; F01K 23/16; F01K 23/18; F01K 11/00; F01K 11/02; F01K 11/04; F25B 2400/14; F25B 2400/141; F25B 11/00; F25B 11/02; F25B 11/04
See application file for complete search history.

(56) References Cited

U.S. PATENT DOCUMENTS 5,761,921 A * 6/1998 Hori ..... F25B 11/00 62/324.1
6,571,548 B1 * 6/2003 Bronicki ..... F01K 23/10 60/39.181
6,651,443 B1 * 11/2003 Meckler ..... F25B 15/06 60/39.182
7,574,856 B2 * 8/2009 Mak ..... F01K 23/10 60/645
7,985,278 B2 * 7/2011 Guidati ..... B01D 53/62 55/459.1
2004/0255593 A1 * 12/2004 Brasz ..... F02C 6/18 60/39.182
2005/0188711 A1 * 9/2005 Wang ..... F02B 75/04 62/238.1
2006/0130482 A1 * 6/2006 Chino ..... F01K 17/025 60/670
2008/0008602 A1 * 1/2008 Pozivil ..... F17C 9/00 417/247
2008/0289335 A1 * 11/2008 Drysdale ..... H02M 7/10 60/649
2009/0266096 A1 10/2009 Minds et al.
2013/0156543 A1 * 6/2013 Sassanelli ..... F04D 31/00 415/122.1
2017/0097189 A1 4/2017 Guy

FOREIGN PATENT DOCUMENTS

JP 57026365 A * 2/1982
JP 2002115931 A * 4/2002
RU 2596293 C2 9/2016
WO WO-8707936 A1 * 12/1987
WO 2007/038921 A1 4/2007
WO 2016/207289 A2 12/2016

* cited by examiner

COMBINED HEAT RECOVERY AND CHILLING SYSTEM AND METHOD

TECHNICAL FIELD

Disclosed herein are thermodynamic systems and circuits. Embodiments disclosed herein relate to power generation circuits and refrigeration circuits.

BACKGROUND ART

Combined power generation circuits and refrigeration circuits are known in the art. In some known arrangements, a refrigeration circuit is used in combination with gas turbine engines for increasing the power of the gas turbine engine by chilling the inlet air at the air intake of the turbine.

U.S. Pat. No. 5,632,148 discloses a combined thermodynamic system comprising a gas turbine engine for driving a load. A power generation circuit using a first fluid performing a Rankine cycle and a separate refrigeration circuit using a second fluid are combined with the gas turbine engine. The power generation circuit converts heat recovered from the exhaust of the gas turbine engine into mechanical power. The mechanical power generated by the Rankine cycle is used to drive the compressor of the refrigeration circuit. The refrigeration circuit is in turn used to chill air at the air intake of the gas turbine engine.

These known combined systems are complex and not entirely satisfactory from the point of view of efficiency and flexibility of operation. Moreover, the use of two working fluids results in complexity and increased maintenance costs.

Thermodynamic systems often include a process gas compressor, which is designed to process a flow of process gas at high flow rate, for example in pipelines and other installations. These process gas compressors are driven by prime movers, which may include electric motors. In many circumstances, the process gas compressors are driven by internal combustion engines, using for instance part of the process gas processed by the compressors themselves. Internal combustion engines as understood herein also include, in particular, gas turbine engines.

These installations require a large amount of power.

A need therefore exists for improved combined thermodynamic systems, aimed at reducing power consumption or improve the efficiency thereof, and/or at increasing the production keeping the power of the GT flat (100%)

SUMMARY

According to an aspect, a combined thermodynamic system is disclosed, which comprises a power generation circuit adapted to circulate a first flow of a working fluid and produce mechanical power therewith. The combined thermodynamic system further comprises a refrigeration circuit having a compressor driven by mechanical power generated by the power generation circuit and adapted to circulate a second flow of said working fluid in the refrigeration circuit. The same working fluid is thus used in two different circuits of the combined thermodynamic system to generate mechanical power and to use said mechanical power to drive the refrigeration circuit. The refrigeration circuit is adapted to remove heat from a flow of process gas flowing through a process gas compressor, such that the efficiency of the gas compression process is improved.

In some embodiments the process gas compressor is driven by an engine, specifically an internal or external combustion engine, such as a gas turbine engine, or an internal reciprocating combustion engine, or an external reciprocating combustion engine (such as a Stirling engine). Waste heat generated by the engine is partly converted into useful mechanical power by the power generation circuit. The useful mechanical power thus generated is used to drive the refrigeration circuit. Thus the efficiency of the process gas compressor is improved exploiting waste heat from the engine, which would otherwise be discarded in the environment.

The total working fluid flow can be processed in one cooling section fluidly coupled to the power generation circuit and to the refrigeration circuit. The working fluid flow is split into a first working fluid flow and second working fluid flow downstream of the cooling section. The first working fluid flow is processed through the power generation circuit and undergoes thermodynamic transformations to convert heat into mechanical power. The second working fluid flow is processed in the refrigeration circuit and is subject to thermodynamic transformations to remove heat from a heat source at a lower temperature and release heat at the cooling section, at a temperature higher than the temperature of the heat source. The mechanical power generated by the first working fluid flow in the power generation circuit is exploited to compress the second working fluid flow in the refrigeration circuit.

According to a further aspect, a method for chilling a flowing medium, in particular process gas processed in a process gas compressor is disclosed herein. The method can comprise the following steps:

- circulating a first flow of a working fluid in a power generation circuit and generating mechanical power therewith;
- circulating a second flow of the working fluid in a refrigeration circuit by means of a compressor driven by the mechanical power generate by the power generation circuit;
- cooling the process gas by heat exchange with the second flow of working fluid circulating in the refrigeration circuit.

According to another aspect, a combined thermodynamic system is disclosed, comprising a first expander drivingly coupled to a compressor. The system can further include a cooling section, fluidly coupled to a discharge side of the expander and adapted to receive expanded working fluid from the expander. The cooling section can be further fluidly coupled to a delivery side of the compressor, and adapted to receive compressed working fluid from the compressor. A chilling circuit can be provided between the cooling section and a suction side of the compressor. The chilling circuit can comprise a chilling heat exchanger having a cold side adapted to circulate working fluid from the cooling section and in heat exchange relationship with a hot side of the chilling heat exchanger, said hot side adapted to circulate a flow of gas processed by a process gas compressor. The thermodynamic system can further include a power generation circuit section between the cooling section and an inlet of the first expander. The power generation circuit section can comprise a heater adapted to circulate working fluid from the cooling section in heat exchange relationship with a heat source. The heat source can be waste heat from an engine, which drives the process gas compressor. The heater is fluidly coupled to an inlet of the first expander.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS

Figure 1:
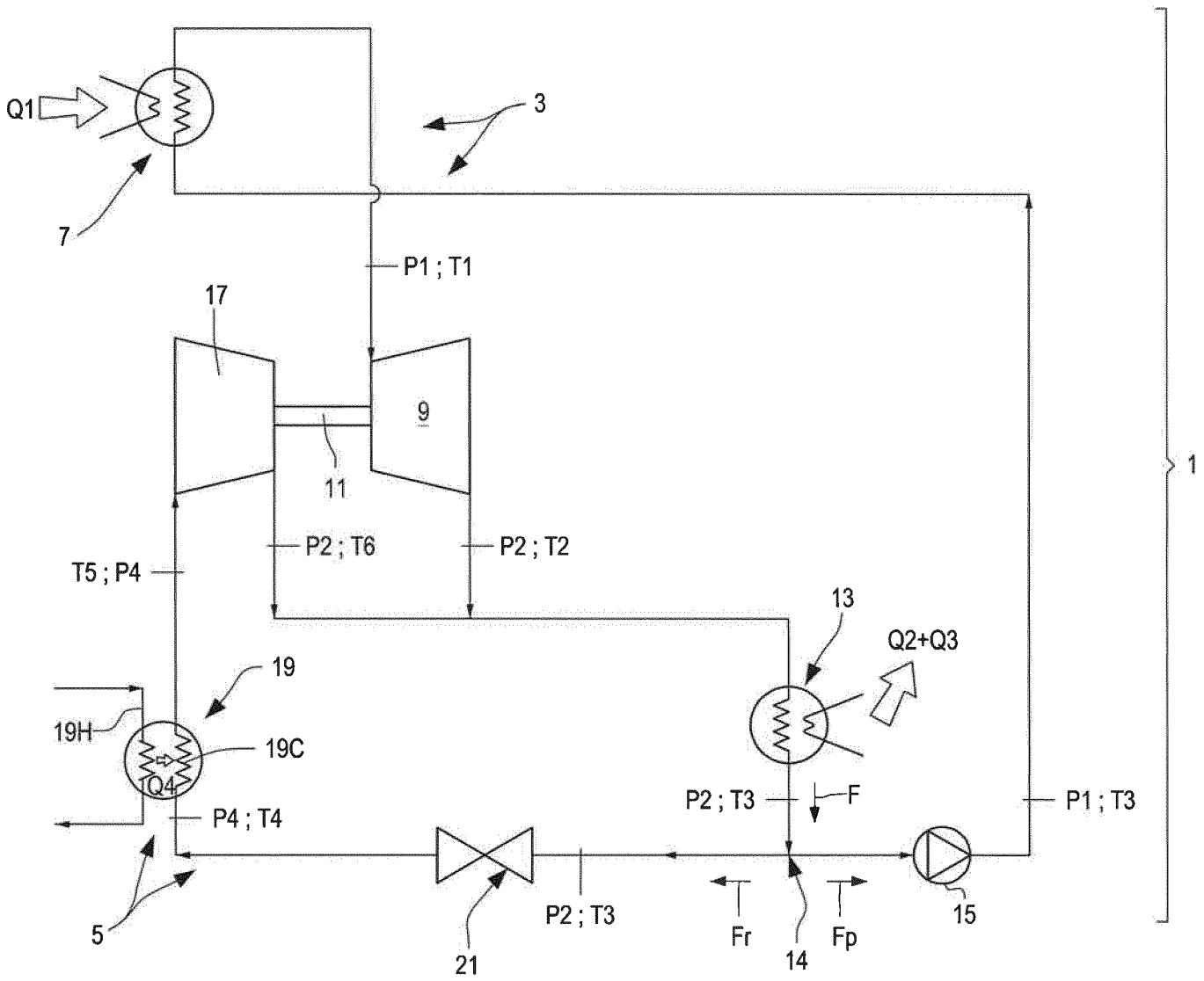
FIG. 1 illustrates a schematic of a first embodiment of a system according to the present disclosure.

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

In the following detailed description, several embodiments of a new combined thermodynamic system are disclosed. The combined thermodynamic system is adapted to convert thermal power into mechanical power and to use the mechanical power to chill or cool a fluid flow. The thermal power can be provided by a source of waste heat, such as exhaust combustion gas from a gas turbine, for instance, or any other source of heat at relatively low temperature. The fluid flow which is cooled or chilled by the thermodynamic system can be, for instance, a flow of intake air of a gas turbine engine, or a flow of process gas processed by a gas compressor. In general, chilling the fluid flow increases the efficiency of the process where the fluid flow is used.

The combined thermodynamic system comprises a combination of a power generation circuit and a refrigeration circuit. The power generation circuit is adapted to convert heat into mechanical power. A working fluid circulating in the power generation circuit undergoes cyclic thermodynamic transformations to convert heat into mechanical power. The combined thermodynamic system further comprises a refrigeration circuit. The working fluid circulating in the refrigeration circuit removes heat from the fluid flow. The refrigeration circuit comprises a compressor, which is driven by mechanical power generated by the power generation circuit.

The power generation circuit and the refrigeration circuit have a common cooling section. Working fluid flowing from the refrigeration circuit and the power generation circuit enters the cooling section and heat is removed therefrom. Downstream of the cooling section, the working fluid flow is split into two separate flows: a first working fluid flow enters the power generation circuit; a second working fluid flow enters the refrigeration circuit.

By using the same working fluid in the power generation circuit and in the refrigeration circuit, a completely sealed system can be obtained. This avoids leakages of working fluid in the environment and prevents buffer gas consumption, which usually occurs in systems which are not completely sealed. Moreover, some of the static equipment (specifically the cooling section) can be shared by the two circuits of the combined thermodynamic system. An efficient and easy to design and maintain system is thus obtained.

Turning now to the attached figures, FIG. 1 illustrates a schematic of a first embodiment of a combined thermodynamic system 1 using a source of heat, for instance a source of waste heat, to refrigerate or chill a fluid flow.

In the embodiment of FIG. 1 the combined thermodynamic system 1 comprises a power generation circuit 3 and a refrigeration circuit 5.

In general terms, the power generation circuit 3 comprises a heat source, or is in heat exchange relationship thereto. The heat source is adapted to deliver heat to a working fluid circulating in the power generation circuit 3. The power generation circuit 3 further comprises a heat sink, or is in heat exchange relationship therewith. The heat sink is adapted to remove heat from the working fluid. In operation, the heat source transfers heat at a first temperature to the working fluid, and the heat sink removes heat from the working fluid at a second temperature, the first temperature being higher than the second temperature. The working fluid is caused to circulate through the power generation circuit 3 and is subject to a sequence of thermodynamic transformations of a thermodynamic cycle. The thermodynamic cycle includes an expansion phase, through which mechanical power is generated, by converting part of the heat provided by the heat source into mechanical power.

In some embodiments, the thermodynamic cycle is a Rankine cycle. In currently preferred embodiments, the thermodynamic cycle is an organic Rankine cycle, here in also shortly referred to as ORC. The working fluid circulating in the power generation circuit 3 can thus be an organic fluid. In embodiments disclosed herein the working fluid can include, for example and without limitation: pentane, cyclopentane, hydrofluorocarbon (HFC), propane, isopropane, butane, isobutane, $CO_2$, liquefied natural gas, ammonia.

The power generation circuit 3 can comprise a heater 7, having a cold section and a hot section. The heater 7 operates as the heat source of the power generation circuit 3, or is in heat exchange relationship therewith.

The working fluid circulating in the power generation circuit 3 flows through the cold section of the heater 7 and receives heat Q1. Heat can be waste heat from another process, such as heat from exhaust combustion gas of a gas turbine engine, or heat from a condenser of a steam turbine cycle. In other embodiments, the heat source can comprise a solar power plant, for instance a concentrated solar power plant. In further embodiments, the heat source can comprise a bio-mass plant, a geothermal heat source, or the like.

The power generation circuit 3 can further comprise a power generation circuit section comprised of at least a first turbomachine 9, wherein working fluid is expanded. In some embodiments, the turbomachine 9 can comprise an expander, e.g. a turboexpander. The turboexpander 9 can be a single-stage or multi-stage turboexpander.

The working fluid enters the turboexpander at a pressure P1 and at a temperature T1, expands in the turboexpander 9 and is discharged from the turboexpander 9 at a pressure P2 and a temperature T2. The enthalpy drop across the turboexpander 9 generates mechanical power which is available on a turboexpander shaft 11. As known, enthalpy is defined as a thermodynamic quantity equivalent to the total heat content of a system. It is equal to the internal energy of the system plus the product of pressure and volume.

The power generation circuit 3 further comprises a cooling section 13. The cooling section 13 functions as the heat sink for the power generation circuit 3.

The cooling section 13 can comprise one or more heat exchangers and can be configured to condense the working fluid. The working fluid in a liquid state at pressure P2 and temperature T3 exits the cooling section 13 and is delivered to a suction side of a pump 15 arranged in the power generation circuit 3. The pump 15 boosts the pressure of the condensed working fluid from pressure P2 to pressure P1 and pumps the working fluid to the heater 7, where the working fluid is vaporized and can be super-heated.

In general terms, the refrigeration circuit 5 comprises a heat source, from which heat is delivered to the working fluid circulating in the refrigeration circuit 5, and a heat sink, where heat is removed from the working fluid. The heat sink is at a temperature higher than the heat source, such that mechanical work is needed to transfer heat from the heat source to the heat sink. The refrigeration circuit therefore comprises a compressor machine and an expander device. The power delivered to the compressor machine is used to "pump" the heat from the lower-temperature heat source to the higher-temperature heat sink.

In the embodiment of FIG. 1, the refrigeration circuit 5 comprises a compressor 17, for instance a centrifugal compressor, or an axial compressor, or a combined axial-centrifugal compressor. In further embodiments, the compressor 17 can be a positive displacement compressor, such as a reciprocating compressor or a screw compressor. The suction side, i.e. the low-pressure side, of the compressor 17 is fluidly coupled to a chilling circuit section, comprising a chilling heat exchanger 19. The working fluid circulates through a cold side 19C of the chilling heat exchanger 19, while a flow of a fluid to be chilled circulates in a hot side 19H of the chilling heat exchanger 19. The chilling heat exchanger 19 thus functions as the heat source of the refrigeration circuit 5.

The delivery side of the compressor 17 is fluidly coupled to the cooling section 13. The chilling circuit section of the refrigeration circuit 5 further comprises an expansion device 21, such as a Joule-Thomson expansion valve, or an expander. The expansion device 21 is fluidly coupled to the outlet side of the cooling section 13 and to the inlet of the cold side 19C of the chilling heat exchanger 19.

Working fluid at pressure P2 and temperature T3 at the outlet side of the cooling section 13 is expanded through the expansion device 21 to a pressure P4 and a temperature T4, lower than pressure P2 and temperature T3 at the outlet side of the cooling section 13. Depending upon the design of the system, the temperature T4 can be as low as −45° C. or lower.

The low-temperature and low-pressure working fluid is heated at a temperature T5 in the chilling heat exchanger 19 by heat Q4 removed from the fluid flow circulating in the hot side 19H of the chilling heat exchanger 19. The thus heated working fluid is delivered to the suction side of compressor 17.

Working fluid processed by compressor 17 is delivered at the delivery side of compressor 17 at a temperature T6 and pressure P2, higher than temperature T5 and pressure P4 and is fed to the cooling section 13, where the working fluid is cooled and condensed by removing heat Q3.

The compressor 17 is mechanically coupled to the turboexpander 9 through shaft 11 and is driven by mechanical power generated by the turboexpander 9.

The power generation circuit 3 and the refrigeration circuit 5 have at least one common section or element, namely the cooling section 13. The same working fluid is thus caused to circulate in both the power generation circuit 3 and in the refrigeration circuit 5. A total working fluid flow F flows through the cooling section 13 and is made available at the outlet of the cooling section 13. In point 14 the total working fluid flow F is split into a first working fluid flow Fp, which is caused to circulate in the power generation circuit 3, and in a second working fluid flow Fr, which is caused to circulate in the refrigeration circuit 5. Thus, the same working fluid is used in both circuits 3, 5 and said circuits can be designed as a sealed combined system.

As will become clear from the following description of further embodiments, heat Q1 can be provided by any suitable source of heat, for instance a source of waste heat to be recovered. Specifically if an ORC power generation circuit is used, heat Q1 can be provided at relatively "low" temperature, such as the temperature of exhaust combustion gas at the discharge plenum of a gas turbine engine, or the lower temperature of a steam Rankine cycle, or else the temperature of a geothermal source or of a solar power plant, such as a concentrated solar power plant.

As will become clear from the following description of further embodiments, the fluid flow circulating in the hot side 19H of the chilling heat exchanger 19 can be any flow of fluid which requires to be cooled. For instance, the fluid flow can be a flow of air or a flow of process gas. In other embodiments, the fluid flow can be a flow of liquid.

Figure 2:
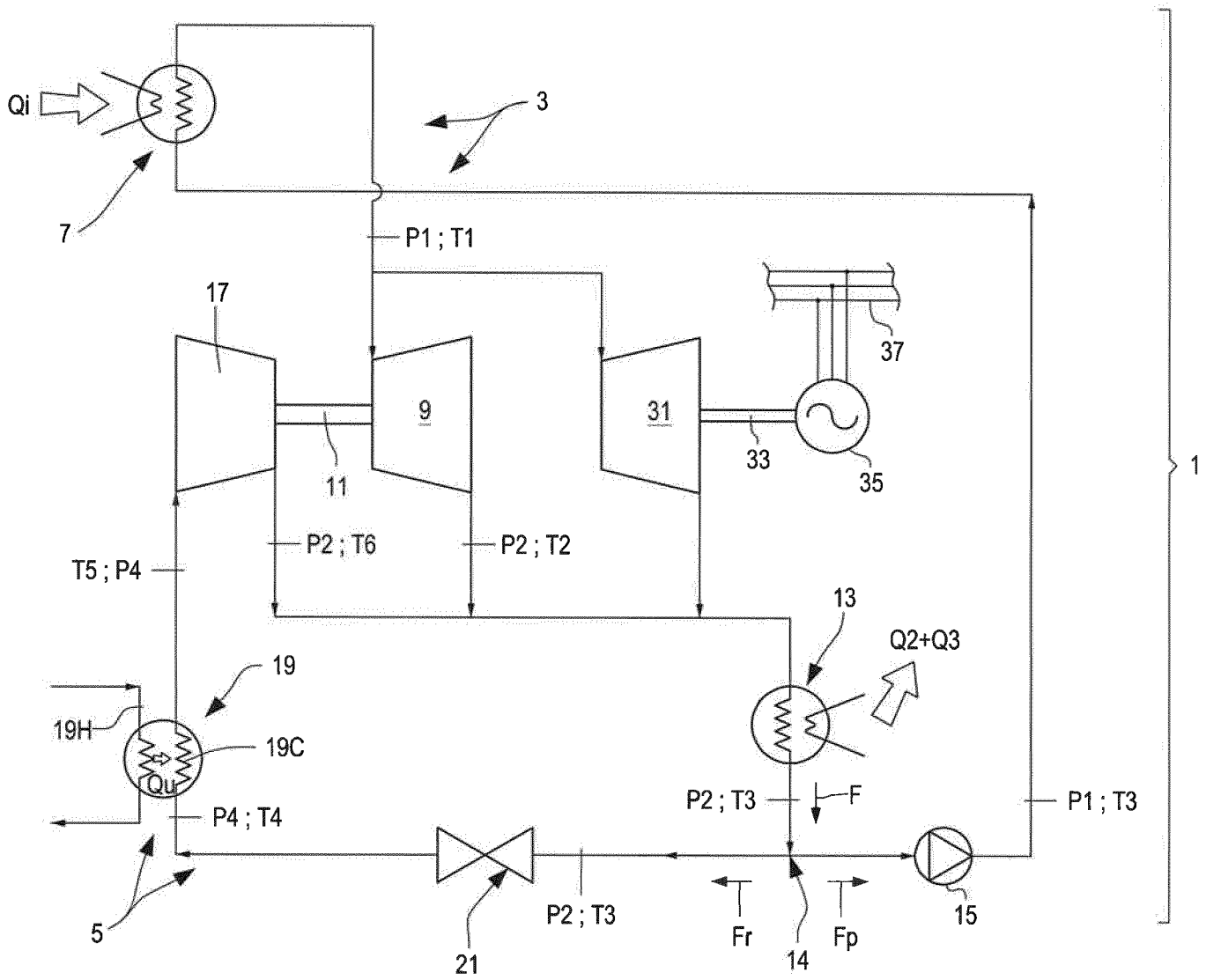
FIG. 2 illustrates a schematic of a second embodiment of a system according to the present disclosure.

Referring now to FIG. 2, with continuing reference to FIG. 1, a further embodiment of a combined thermodynamic system according to the present disclosure is shown. The same reference numbers designate the same or similar components as already described in connection with FIG. 1, and which will not be described again.

In the embodiment of FIG. 2, the power generation circuit 3 further comprises a second turbomachine 31, wherein working fluid is expanded. In some embodiments, the second turbomachine 31 can comprise an expander, e.g. a turboexpander, such as a single-stage or a multi-stage turboexpander. The second turboexpander 31 is adapted to receive working fluid circulating in the power generation circuit 3. The second turboexpander 31 generates mechanical power by expanding the working fluid which circulates through the second turboexpander 31. The mechanical power generated by the second turboexpander 31 is made available through an output shaft 33, which can be mechanically coupled to a load. In some exemplary embodiments the load can comprise an electrical generator 35, which converts mechanical power generated by the second turboexpander 31 into useful electrical power. The electrical generator 35 can be electrically connected to an electrical power distribution grid 37. The electrical power generated by the electrical generator 35 can be used to power electrical loads, for example auxiliary electric and electronic devices of the combined thermodynamic system 1, including the pump 15, for instance.

In the exemplary embodiment of FIG. 2, the second turboexpander 31 is arranged in parallel to the first turboexpander 9, such that the pressure and temperature of the working fluid at the inlets of the first turboexpander 9 and of the second turboexpander 31 are the same, or substantially the same. In other embodiments, not shown, the first turboexpander 9 and second turboexpander 31 can be arranged in series, such that the discharge side of one of said first and second turboexpanders is fluidly coupled to the inlet of the other of said first and second turboexpanders and the total enthalpy drop of the working fluid is split between the sequentially arranged first and second turboexpanders.

Adjusting valves can be arranged to adjust the flow rate of the working fluid through the first turboexpander 9 and the second turboexpander 31, for instance, if the two turboexpanders 9 and 31 are arranged in parallel. Alternatively, or in combination, adjusting valves can be arranged to adjust the enthalpy drop across the first turboexpander 9 and the second turboexpander 31. For instance, if the first and second turboexpanders 9, 31 are arranged in series, an intermediate adjustment valve positioned between the first turboexpander 9 and the second turboexpander 31 can be used to adjust the discharge pressure of the most upstream turboexpander, and thus to adjust the enthalpy drop in the two turboexpanders.

Thus, by using two turboexpanders in series or in parallel, the amount of mechanical power exploited by the refrigeration circuit 5 can be modulated, using a control system or other means, which adjust the flow rate and/or the enthalpy drop across the first turboexpander 9 and the second turboexpander 31, according to needs, e.g. by acting upon the above mentioned adjusting valves. Excess mechanical power produced by the power generation circuit 3, not required to drive the refrigeration circuit 5, can be exploited to generate useful electrical power.

In other embodiments, not shown, the mechanical power generated by the second turboexpander 31 can be used to drive a different load, for instance a turbo-pump or a compressor, rather than an electrical generator. In some embodiments, at least part of the mechanical power available on shaft 33 can be used to directly drive the pump 15, such that a separate electrical motor to drive pump 15 can be dispensed with.

In other embodiments, the pump 15 can be directly driven by mechanical power generated by the first turboexpander 9.

Figure 3:
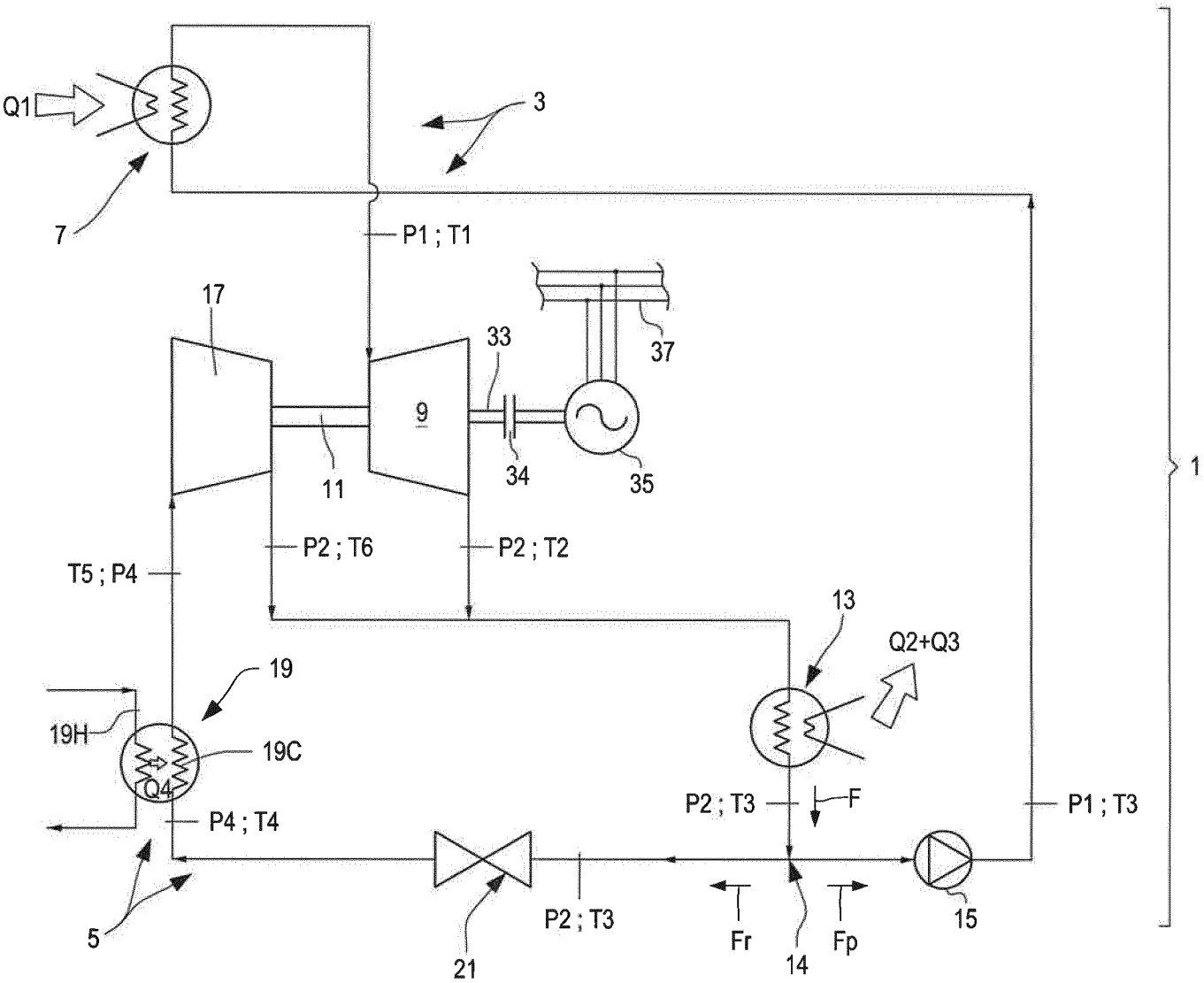
FIG. 3 illustrates a schematic of a third embodiment of a system according to the present disclosure.

FIG. 3, with continuing reference to FIGS. 1 and 2, illustrates a further embodiment of the combined thermodynamic system 1 of the present disclosure. The same reference numbers as used in FIGS. 1 and 2 designate the same or similar elements, parts or components, which will not be described again.

In the embodiment of FIG. 3 only a first turboexpander 9 is provided, which can be mechanically coupled to the compressor 17 and to an electrical machine 35, such as an electrical generator or another rotary load. In the embodiment of FIG. 3, the compressor 17 and the electrical generator 35 are connected to two shafts, or to two shaft ends, on opposite sides of the turboexpander 9. In other embodiments, the electrical generator 35 and the compressor 17 can be arranged on the same side of turboexpander 9.

If the turboexpander 9 generates more mechanical power than required to drive the compressor 17, the excess power can be used to drive the electrical generator 35, or any other rotary load mechanically coupled to the turboexpander 9. If no power is available to drive the electrical generator 35, or another rotary load coupled to the turboexpander 9, the electrical generator 35 can rotate idly, or a clutch 34 arranged on the driving shaft 33 can be decoupled.

The embodiments of FIGS. 2 and 3 can advantageously be used when the heat source is designed to or capable of providing an amount of thermal energy, which is or can be higher than the thermal energy required to chill the fluid flow circulating in the hot side 19H of the chilling heat exchanger 19.

In some embodiments, the electrical generator 35 can be adapted to operate alternatively as a helper and as a generator. If the mechanical power generated by the turboexpander 9 is insufficient to drive the compressor 17 of the refrigeration circuit 5, the electrical machine 35 can be switched in a helper mode and be operated as an electrical motor to supply additional mechanical power to operate the compressor 17.

Figure 4:
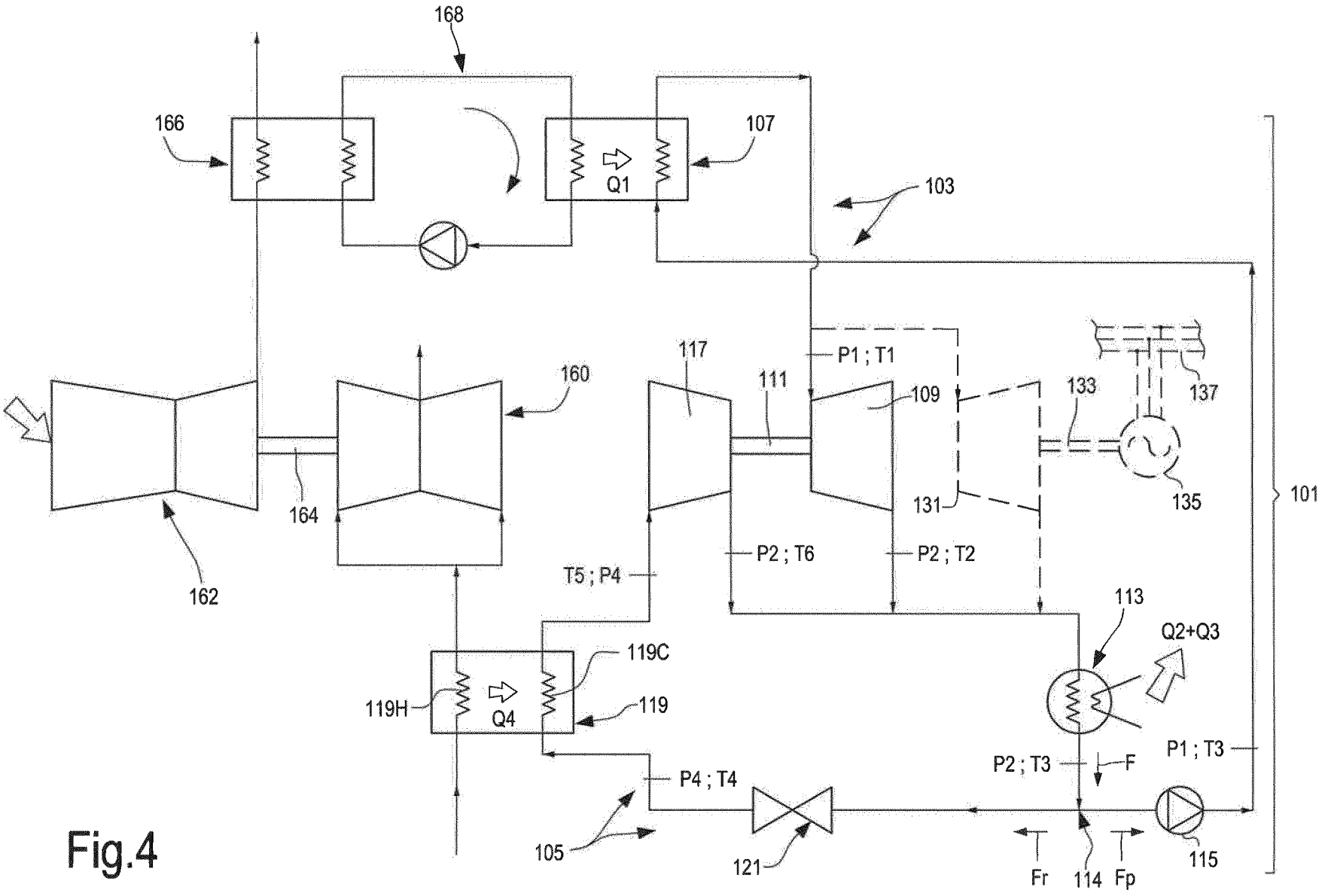
FIG. 4 illustrates a schematic of a fourth embodiment of a system according to the present disclosure.

FIG. 4 illustrates a further embodiment of a combined thermodynamic system 1 adapted to exploit a heat source to drive a refrigeration cycle. The same or similar elements as already disclosed in FIG. 1, 2 or 3 are labeled with the same reference numbers increased by "100".

In the embodiment of FIG. 4 the combined thermodynamic system 101 comprises a power generation circuit 103 and a refrigeration circuit 105. The power generation circuit 103 generates mechanical power by means of a thermodynamic cycle, e.g. Rankine cycle, preferably an ORC, exploiting waste heat recovered from the exhaust combustion gas of a gas turbine engine, as will be described here on.

The power generation circuit 103 can comprise a heater 107, having a cold section and a hot section. The heater 107 operates as the heat source of the power generation circuit 103.

The working fluid circulating in the power generation circuit 103 flows through the cold section of the heater 107 and receives heat Q1 from a flow of exhaust combustion gas, to be described. The power generation circuit 103 can further comprise at power generation circuit section comprised of least a first turbomachine 109, e.g. a turboexpander 109, wherein working is expanded. The turboexpander 109 can be a single-stage or multi-stage turboexpander.

The working fluid enters the turboexpander 109 at a pressure P1 and at a temperature T1, expands in the turboexpander 109 and is discharged from the turboexpander 109 at a pressure P2 and a temperature T2, lower than pressure P1 and temperature T1. The enthalpy drop across the turboexpander 109 generates mechanical power, which is available on a turboexpander shaft 111.

The power generation circuit 103 further comprises a cooling section 113. The cooling section 113 operates as the heat sink for the power generation circuit 103.

The cooling section 113 can comprise one or more heat exchangers and can be configured to condense the working fluid. The working fluid in a liquid state at pressure P2 and temperature T3 exits the cooling section 113 and is delivered at a suction side of a pump 115 of the power generation circuit 103. The pump 115 boosts the pressure of the condensed working fluid from pressure P2 to pressure P1 and pumps the working fluid to the heater 107, where the working fluid is vaporized and can be super-heated.

In the embodiment of FIG. 4, the refrigeration circuit 105 comprises a refrigerant compressor 117 (here on also simply referred to as "compressor"), for instance a centrifugal compressor, or an axial compressor, or a combined axial-centrifugal compressor. In further embodiments, the refrigerant compressor 117 can be a positive displacement compressor, such as a reciprocating compressor or a screw compressor. The suction side of the compressor 117 is fluidly coupled to a chilling heat exchanger 119 arranged in a chilling circuit section of the refrigeration circuit 105. The working fluid circulates through a cold side 119C of the chilling heat exchanger 119, while a flow of a fluid to be chilled circulates in a hot side 119H of the chilling heat exchanger 119. The chilling heat exchanger 119 operates as the heat source of the refrigeration circuit 105.

The delivery side of the compressor 117 is fluidly coupled to the cooling section 113. The refrigeration circuit 105 further comprises an expansion device 121, such as a Joule-Thomson expansion valve, an expander, or the like. The expansion device 121 is fluidly coupled to the outlet side of the cooling section 113 and to the inlet of the cold side 1190 of the chilling heat exchanger 119.

Working fluid at pressure P2 and temperature T3 at the outlet side of the cooling section 113 is expanded through the expansion device 121 to a pressure P4 and a temperature T4, lower than pressure P2 and temperature T3 at the outlet side of the cooling section 113. Depending upon the design of the system, the temperature T4 can be as low as −45° C. or lower.

The low-temperature and low-pressure working fluid is heated at a temperature T5 in the chilling heat exchanger 119 by heat Q4 removed from the fluid flow circulating in the hot side 119H of the chilling heat exchanger 119. The thus heated working fluid is delivered to the suction side of compressor 117.

Working fluid processed by compressor 117 is delivered by compressor 117 to the cooling section 113 at a temperature T6 and pressure P2, higher than temperature T5 and pressure P4. In the cooling section 113 the working fluid is cooled and condensed by removing heat Q3.

The compressor 117 is mechanically coupled to the turboexpander 109 through shaft 111 and is driven by mechanical power generated by the turboexpander 109 through turboexpander shaft 111.

The power generation circuit 103 and the refrigeration circuit 105 have at least one common section or element, namely the cooling section 113. The same working fluid is thus caused to circulate in both the power generation circuit 103 and in the refrigeration circuit 105. A total working fluid flow F is delivered at the outlet of the cooling section 113. In point 114 the total working fluid flow F is split into a first working fluid flow Fp, which is caused to circulate in the power generation circuit 3, and in a second working fluid flow Fr, which is caused to circulate in the refrigeration circuit 105. Thus, the same working fluid is used in both circuits 103, 105 and said circuits can be designed as a sealed combined system.

In the exemplary embodiment of FIG. 4 the fluid flow circulating in the hot side 119H of the chilling heat exchanger 119 can be a flow of process gas processed by a process gas compressor 160. In the arrangement of FIG. 4 the chilling heat exchanger 119 is arranged such as to chill the process gas at the suction side of the process gas compressor 160. By reducing the suction side temperature of the process gas, less power is required to process the same process gas flowrate, or a higher process gas flowrate can be processed by the process gas compressor 160 with the same amount of mechanical power.

In some embodiments, not shown, the process gas compressor 160 can be driven into rotation by an electrical motor.

In the embodiment illustrated in FIG. 4, however, the prime mover which drives into rotation the process gas compressor 160 is a gas turbine engine 162. Reference 164 designates a turbine shaft, which drivingly couples the gas turbine engine 162 to the process gas compressor 160.

In the embodiment of FIG. 4 exhaust combustion gas from the gas turbine engine 162 is delivered to a waste heat recovery heat exchanger 166. In the waste heat recovery heat exchanger 166, heat Q1 is removed from the exhaust combustion gas and directly or indirectly delivered to the power generation circuit 103.

In some embodiments, as shown in FIG. 4, an intermediate thermal transfer circuit 168 is arranged between the waste heat recovery heat exchanger 166 and the heater 107, mainly for the sake of safe operation of the combined thermodynamic system 1. A heat transfer fluid, such as water, diathermic oil, or any other heat transfer medium, can circulate in the intermediate thermal transfer circuit 168 to remove heat from the exhaust combustion gas in the waste heat recovery heat exchanger 166 and deliver said heat, through heater 107, to the working fluid circulating in the power generation circuit 103. Thus, the heater 107 is adapted to transfer heat Q1 from the waste heat recovery heat exchanger 166 to the working fluid which circulates in the power generation circuit 103.

In other embodiments, a direct heat transfer from the flow of exhaust combustion gas to the working fluid can be provided. In such case (not shown) the waste heat recovery heat exchanger 166 operates as a heater for the power generation circuit 103 and comprises a hot side, where the exhaust combustion gas circulates in heat exchange relationship with the working fluid, which circulates in a cold side of the waste heat recovery heat exchanger 166.

The combined thermodynamic system 101 of FIG. 4 can include a second turboexpander 133, adapted to drive an auxiliary load, such as an electrical generator 135, to deliver electrical power to an electrical power distribution grid 137, or directly to an electrically driven load, for instance a motor-pump. As described in connection with FIG. 2, the first turboexpander 109 and second turboexpander 133 can be arranged in parallel, as shown, or in series. In some embodiments, the first turboexpander 109, the second turboexpander 131 and the rotating load 135 can be arranged on the same shaft line. The rotating load 135 can thus be an electrical machine adapted to operate as an electrical generator and as an electrical motor (if switched to a helper mode). Mechanical power provided by the helper can supplement the mechanical power generated by the first (and possibly second) turboexpander, if insufficient heat is available.

In other embodiments, not shown, a single turboexpander 109 can be mechanically coupled to the compressor 117 and to an electrical machine 135. In some embodiments, the electrical machine can operate only in a generator mode, if a surplus of mechanical power is available, and can rotate idly or can be detached from the shaft line, e.g. by means of a clutch, if no surplus mechanical power is available. In other embodiments, the electrical machine can be a reversible machine adapted to operate selectively as an electrical generator and as an electrical motor (helper mode), such as to provide additional mechanical power to drive the compressor 117.

If required, a variable frequency driver (VFD) or any other electrical power conditioning device can be arranged between the electrical power distribution grid 137 and the electrical machine 135, such that the latter can rotate at a speed different from the grid frequency.

In some embodiments, mechanical power from the turboexpander 109 or 131 (if provided), can be used to directly drive the pump 115.

In further embodiments, not shown, the first turboexpander 109 can be connected to a further rotary load, as shown in FIG. 3.

The combined thermodynamic system 101 of FIG. 4 can thus improve the overall efficiency of a process gas compressor 160 and relevant prime mover (gas turbine engine 162), by exploiting waste heat from the exhaust combustion gas to produce mechanical power which powers the refrigeration circuit 105. The refrigeration circuit 105 cools the process gas at the suction side of the process gas compressor 160, thus reducing the power needed to drive the compressor.

In other embodiments, not shown, the process gas compressor 160 can be driven by another prime mover, e.g. by an electrical motor, rather than by a gas turbine engine 162. In such case a different source of heat for the power generation circuit 103 can be provided, e.g. a solar plant, or a condenser of a top steam turbine cycle.

Figure 5:
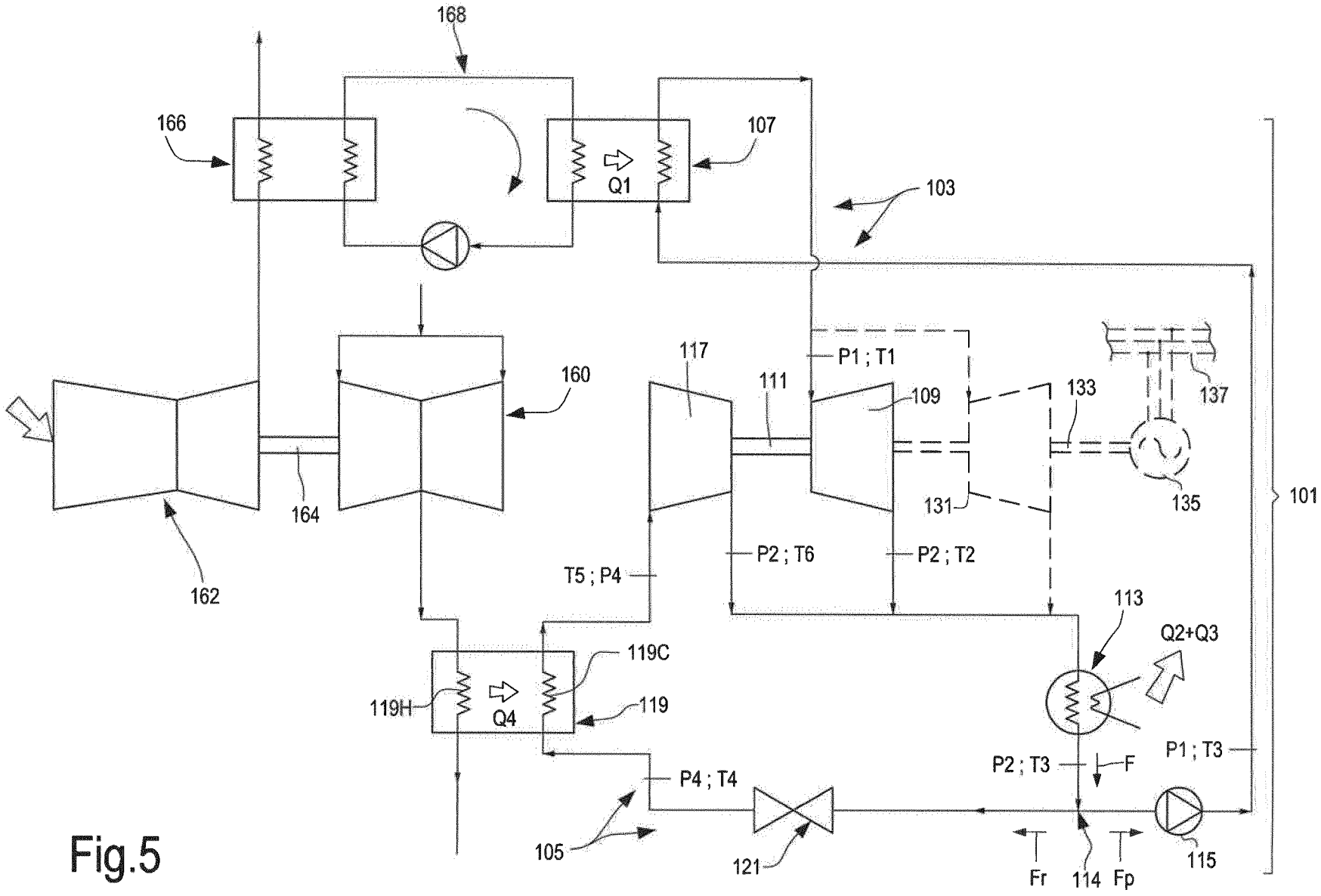
FIG. 5 illustrates a schematic of a fifth embodiment of a system according to the present disclosure.

Referring now to FIG. 5, with continuing reference to FIGS. 1 to 4, a further embodiment of a combined thermodynamic system 101 according to the present disclosure is illustrated. The combined thermodynamic system 101 of FIG. 5 exploits thermal energy to produce mechanical power to drive a refrigeration circuit 105. The same reference numbers as used in FIG. 4 designate the same or similar parts or components already described with reference to FIG. 4. These elements, parts or components will not be described again.

The refrigeration circuit 105 of FIG. 5 is used to cool a fluid flow to improve the efficiency or the output of a process gas compressor 160. Similarly to FIG. 4, also in FIG. 5 the process gas compressor 160 is driven by a gas turbine engine 162, and the waste heat from exhausted combustion gas of the gas turbine engine 162 is partly converted into mechanical power by the power generation circuit 103, to operate the refrigeration circuit 105.

The embodiment of FIG. 5 differs from the embodiment of FIG. 4 in that the chilling heat exchanger 119 is arranged and configured to cool the process gas at the delivery side of the process gas compressor 160, rather than at the suction side thereof. The remaining arrangement of the combined thermodynamic system 101 is the same as shown in FIG. 4. The arrangement of FIG. 5 can be used e.g. when the compressed process gas delivered by the process gas compressor 160 requires to be chilled prior to be delivered to a further process section (not shown).

All alternative embodiments mentioned in connection with FIG. 4 can be provided also in connection with FIG. 5.

In further embodiments, not shown, the two arrangements of FIGS. 4 and 5 can be combined. Two chilling heat exchangers or a single chilling heat exchanger 119 can be used, to chill the process gas at the suction side and at the delivery side of the process gas compressor 160.

In yet further embodiments, not shown, the chilling heat exchanger 119 can be used as an intercooling heat exchanger, between a first stage and a second stage of an intercooled process gas compressor.

In yet further embodiments, the working fluid circulating in the refrigeration circuit 105 can be used in combination as a cooling medium in an intercooler and/or to chill the process gas at the suction side and/or at the delivery side of the process gas compressor 160.

Several process gas compressors in series or in parallel can be provided, forming a process gas compressor arrangement. Cooling or chilling of process gas can be achieved by means of the working fluid circulating in the refrigeration circuit 105 in various positions of said process gas compressor arrangement.

Figure 6:
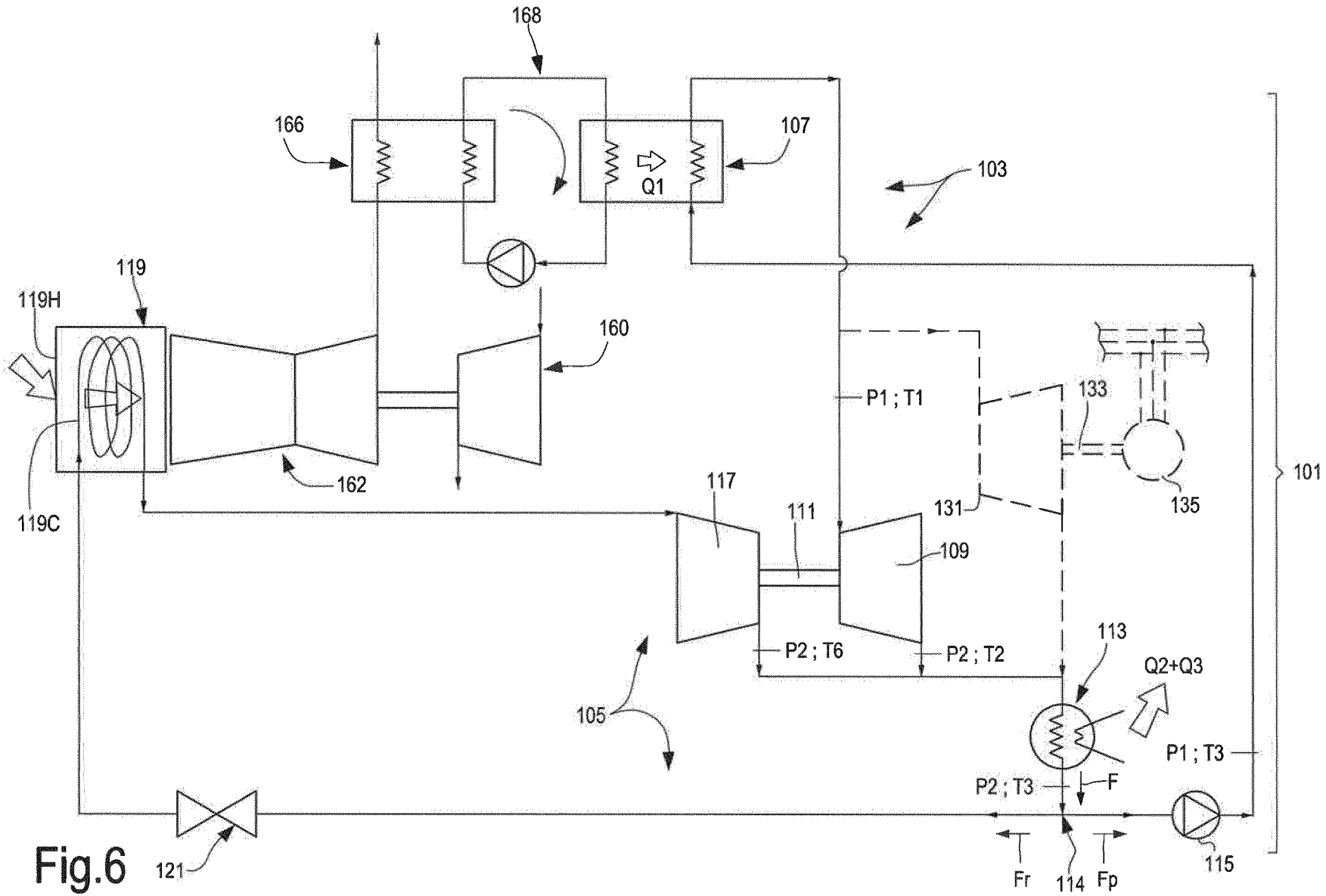
FIG. 6 illustrates a schematic of a sixth embodiment of a system according to the present disclosure.

In FIG. 6, with continuing reference to FIGS. 1 to 5, a further embodiment of the combined thermodynamic system 101 of the present disclosure is shown. The same reference numbers as used in FIGS. 4 and 5 are used to designate the same or similar parts, elements or components already disclosed in FIGS. 4 and 5. These parts, elements or components will not be described again.

In FIG. 6 the chilling heat exchanger 119 is configured to chill or cool air at the air intake of the gas turbine engine 162. By chilling the air ingested by the gas turbine engine 162, the power rate of the gas turbine engine 162 and/or the efficiency thereof can be improved. The overall efficiency of the system is increased by exploiting waste heat of the exhaust combustion gas from the gas turbine engine 162 and by using said waste heat to generate mechanical power to run the refrigeration circuit 105.

The embodiments of FIGS. 4, 5 and 6 can be variously combined to one another. For instance, the refrigeration circuit 105 can be configured and arranged to chill the process gas at the suction side and at the delivery side of the process gas compressor 160. In other embodiments, the refrigeration circuit 105 can be configured and arranged to chill the process gas at the suction side of the process gas compressor 160 and to further chill air at the air intake of the gas turbine engine 162; or to chill the process gas at the delivery side of the process gas compressor 160 and to further chill air at the air intake of the gas turbine engine 162. In yet further embodiments, the refrigeration circuit 105 can be configured and arranged to chill the process gas at the suction side, as well as at the delivery side of the process gas compressor 160 and to further chill air at the air intake of the gas turbine engine 162.

While exemplary embodiments of the disclosure have been set forth in detail above, in connection with the attached drawings, more broadly, disclosed herein is a combined thermodynamic system having a first, power generation circuit to produce power by means of a working fluid, which performs a thermodynamic cycle therein and converts thermal power into mechanical power. The combined system thermodynamic further comprises a second, refrigeration circuit, wherein working fluid performs a second thermodynamic refrigeration cycle, exploiting mechanical power generated by the working fluid circulating in the first circuit. Two distinct flows of the same working fluid are processed in the first, power generation circuit and in the second, refrigeration circuit.

The power generation circuit can exploit heat from any suitable source of heat. In some embodiments, the source of heat is a low-temperature heat source, which can be exploited in a convenient manner e.g. through an Organic Rankine Cycle.

In some embodiments, the heat source can be a waste heat source. For instance, a waste heat recovery heat exchanger can be used to directly or indirectly transfer heat to the power generation circuit. Waste heat can be extracted from any process, where waste heat is generated as by-product.

In some embodiments, waste heat can be recovered from a top, high temperature cycle.

The power generation circuit can further comprise a first expander adapted to receive the first flow of working fluid from the heater and to expand at least part of the first flow of working fluid from a first pressure to a second pressure and generate mechanical power therewith. The first expander can be drivingly coupled to the compressor of the refrigeration circuit to drive the compressor with said mechanical power.

In some embodiments, the power generation circuit can comprise a second expander adapted to generate additional mechanical power from the first flow of working fluid. The second expander can be mechanically coupled to a load.

The first and second expanders can be arranged in sequence, such that the first working fluid flow is expanded sequentially in the first expander and in the second expander. The first expander can be arranged upstream of the second expander with respect to the direction of flow of the first working fluid flow, or vice-versa. The enthalpy drop in the first expander and in the second expander can be adjusted, by adjusting an intermediate pressure between the first expander and the second expander, for instance by means of an intermediate adjusting valve.

In other embodiments, the first expander and the second expander can be arranged in parallel. In this case, a portion of the first working fluid flow expands in the first expander and another portion of the first working fluid flow expands in the second expander. The flow rate through the first expander and the second expander can be adjusted, e.g. by means of suitable valves.

The first expander and the second expander can be mechanically separate from one another. In other embodiments, the first expander and the second expander can be arranged on the same shaft line.

An auxiliary load, for instance an electrical generator, can be powered by the first expander or by the second expander, if sufficient mechanical power can be generated by the power generation circuit.

The electrical generator can be electrically coupled to an electrical power distribution grid. An electrical power conditioning device, such as a variable frequency drive, can be arranged between the electrical generator and the electrical power distribution grid.

In some embodiments, an electrical machine can be drivingly coupled to the first and/or to the second expander, and can be adapted to operate as an electrical generator and as an electrical motor (in a helper mode), to provide additional mechanical power to drive the compressor of the refrigeration circuit, if required.

According to exemplary embodiments the power generation circuit further comprises a pump, adapted to circulate the first flow of working fluid therein. The pump is adapted to pressurize the working fluid and is arranged between the cooling section and the heater and fluidly coupled thereto.

The pump can be driven by an electrical motor. In some embodiments, the pump can be driven by electrical power generated by an electrical generator driven by an expander of the power generation circuit.

In some embodiments, the pump can be driven by mechanical power generated by the expander (or one of the expanders) of the power generation circuit.

The refrigeration circuit can comprise a chilling heat exchanger fluidly coupled to the cooling section and to the compressor, and adapted to circulate the second flow of working fluid from the cooling section in heat exchange relationship with a flow of fluid to be chilled.

The refrigeration circuit can further comprise an expansion device arranged between the cooling section and the chilling heat exchanger. The expansion device is adapted to expand the second flow of working fluid, such as to cool the second working fluid flow to a temperature lower than the flow medium to be cooled or chilled.

The expansion device can be a laminating or throttling valve, e.g. a Joule-Thomson valve. In some embodiments, the expansion device can include a further expander, wherewith mechanical power can be recovered from the expansion. A rotary load, e.g. an electrical generator can be driven by the power generated by the expansion device of the refrigeration circuit.

The system can further comprise a process gas compressor having a suction side and a delivery side. The refrigeration circuit can be adapted to remove heat from process gas processed by the process gas compressor. For instance, the hot side of the chilling heat exchanger can be configured to receive process gas and remove heat therefrom by heat exchange with the second flow of working fluid circulating in the cold side of the chilling heat exchanger. The process gas can be chilled either at the suction side or at the delivery side of the process gas compressor, or at both the suction side and delivery side of the process gas compressor.

The process gas compressor can be an intercooled process gas compressor. The intercooler can be chilled through the refrigeration circuit of the combined thermodynamic system.

According to some embodiments, the combined thermodynamic system can include an internal combustion engine. As understood herein an internal combustion engine is any engine, wherein a mixture of air and fuel is ignited to produce hot combustion gas, which generates mechanical power through thermodynamic transformation. For instance, the internal combustion engine can be a gas turbine engine, or alternatively an internal combustion reciprocating engine. Thus, as used herein the term "internal combustion engine" encompasses not only engines where combustion is intermittent (reciprocating engines), but rather also and in particular those engines using continuous combustion, such as gas turbines.

Waste heat discharged from the internal combustion engine can be exploited as a source of heat by the power generation circuit. Waste heat can be recovered from exhaust combustion gas and possibly from the lubrication circuit and/or from a cooling circuit of the internal combustion engine.

In some embodiments, the internal combustion engine can comprise an air intake, and the refrigeration circuit of the combined thermodynamic system can be adapted to chill air entering the air intake. The power rate generated by the internal combustion engine can thus be augmented.

Combined thermodynamic systems of the present disclosure can be beneficial in terms of fuel saving, production increase, or both. As a matter of fact, the same combined thermodynamic system can be operated under reduced fuel consumption, for instance to process the same process gas flow rate, saving mechanical power thanks to the reduced gas volume, achieved by chilling the gas using the waste heat generated by the engine. This can result in a reduction of the operating expenses. Fuel saving can also result in beneficial effects in terms of reduction of polluting agents, including NOx, CO and $CO_2$. Conversely, using the same amount of fuel the combined thermodynamic system of the present disclosure can provide an increased output, for instance a higher process gas flow rate.

In embodiments disclosed herein, the same combined thermodynamic system can operated selectively at reduced fuel consumption or increased production, depending upon needs. The operator of the system can select various operating conditions, based upon which effect he desires to achieve (noxious emission reduction and cost reduction, or increased production).

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

For instance, while in the embodiments described above reference is specifically made to centrifugal compressors and to gas turbine engines, in other embodiments, different engines can be used. For instance, any internal combustion engine, not only a gas turbine engine, can be used to drive the process gas compressor. Specifically, reciprocating internal combustion engines can be drivingly coupled to the process gas compressors. In other embodiments, reciprocating external combustion engines, such as Stirling engines, can be used.

Moreover, while rotating dynamic compressors, such as centrifugal compressors, axial compressors, mixed axial-radial compressors can be used to compress the process gas, reciprocating compressors are also not ruled out. In some embodiments, reciprocating combustion engines can drive reciprocating compressors.

The invention claimed is:

1. A combined thermodynamic system, comprising:

a process gas compressor having a suction side and a delivery side and processing a process gas therein;

a sealed fluid circuit circulating a working fluid, the sealed fluid circuit comprising, a power generation circuit comprising:

a first turboexpander;

a second turboexpander;

a heater;

an intermediate thermal transfer circuit coupled to the heater, a heat recovery heat exchanger coupled to the intermediate thermal transfer circuit; and a cooling section configured to condense the working fluid received from a refrigerant compressor, the first turboexpander, and the second turboexpander into a liquid flow that is separated into a first liquid flow and a second liquid flow, the first liquid flow directed to the intermediate thermal transfer circuit;

a refrigeration circuit comprising the refrigerant compressor coupled to the first turboexpander so as to be driven by mechanical power generated by the power generation circuit, the refrigeration circuit further comprising a chilling heat exchanger that receives and cools the process gas using the second liquid flow from the cooling section;

an expansion valve coupled to the cooling section and to an inlet side of the chilling heat exchanger, the expansion valve expanding the second liquid flow before the chilling heat exchanger;

a gas turbine engine coupled to the heat recovery heat exchanger and adapted to drive the process gas compressor, the gas turbine engine generating mechanical power and waste heat; and a shaft coupling the gas turbine engine to the process gas compressor, wherein the intermediate thermal transfer circuit circulates a heat transfer fluid between the heat recovery heat exchanger and the heater to transfer heat from exhaust from the gas turbine engine to the first liquid flow in the heater, and wherein the refrigeration circuit, when driven by the mechanical power produced by the power generation circuit, is configured to cool the process gas that enters the suction side and exits the delivery side of the process gas compressor and to cool combustion air delivered to the gas turbine engine.

2. The combined thermodynamic system of claim 1, wherein the power generation circuit is mechanically coupled to the refrigeration circuit via a shaft, and wherein the shaft is configured to transmit the mechanical power produced by the power generation circuit to the refrigerant compressor of the refrigeration circuit.

3. The combined thermodynamic system of claim 1, wherein the first turboexpander is adapted to receive the first flow of the working fluid from the heater and to expand at least part of the first flow of the working fluid from a first pressure to a second pressure and generate mechanical power therewith, and wherein the first turboexpander is drivingly coupled to the refrigerant compressor to drive the refrigerant compressor with said mechanical power.

4. The combined thermodynamic system of claim 1, wherein the second turboexpander is adapted to generate additional mechanical power from the first flow of the working fluid, and wherein the second turboexpander is mechanically coupled to a load.

5. The combined thermodynamic system of claim 4, wherein the load comprises an electrical generator adapted to convert at least part of said additional mechanical power into electrical power.

6. The combined thermodynamic system of claim 1, wherein the power generation circuit further comprises a pump adapted to circulate the first flow of the working fluid therein.

7. The combined thermodynamic system of claim 1, wherein the refrigeration circuit further comprises the chilling heat exchanger fluidly coupled to the cooling section and to the refrigerant compressor and adapted to circulate the second flow of the working fluid from the cooling section in heat exchange relationship with the process gas.

8. The combined thermodynamic system of claim 7, wherein the expansion valve is arranged between the cooling section and the chilling heat exchanger.

9. The combined thermodynamic system of claim 1, wherein the gas turbine engine comprises an air intake, and wherein the refrigeration circuit is adapted to chill air entering the air intake of the gas turbine engine.

10. The combined thermodynamic system of claim 1, wherein the refrigeration circuit is configured and arranged to remove heat from process gas at the suction side of the process gas compressor, process gas at the delivery side of the process gas compressor, and process gas between sequentially arranged stages of the process gas compressor.

11. The combined thermodynamic system of claim 1, wherein the working fluid is an organic working fluid performing an Organic Rankine Cycle in the power generation circuit.

12. A method for operating a thermodynamic system comprising the following steps:

directing power from a gas turbine engine to a process gas compressor through a shaft so as to drive the process gas compressor and processing a process gas therethrough;

circulating a working fluid through a sealed fluid circuit comprising a power generation circuit including a first turboexpander and a second turboexpander, a refrigeration circuit with a refrigerant compressor and a chilling heat exchanger, and a cooling section common to both the power generation circuit and the refrigeration circuit, in the power generation circuit, directing the working fluid through the first turboexpander and the second turboexpander and generating mechanical power therewith; and combining flow of the working fluid from the first turboexpander, the second turboexpander, and the refrigerant compressor into the cooling section;

in the cooling section, condensing the flow of working fluid into a liquid flow;

separating the liquid flow into a first liquid flow and a second liquid flow;

directing the first liquid flow from the cooling section to a heater in the power generation circuit and the second liquid flow to the chilling heat exchanger;

circulating a heat transfer fluid between a heat recovery heat exchanger and the heater to transfer heat from exhaust from the gas turbine engine to the first liquid flow in the heater;

expanding the second liquid flow upstream of the chilling heat exchanger;

circulating the second liquid flow in the refrigeration circuit by the refrigerant compressor by driving the refrigerant compressor via the mechanical power generated by the power generation circuit; and cooling the process gas entering the suction side and exiting the delivery side of the process gas compressor and the combustion air delivered to the gas turbine engine by heat exchange with the second liquid flow circulating in the refrigeration circuit.

13. The method of claim 12, wherein the step of cooling the process gas comprises:

removing heat from the process gas between sequentially arranged stages of the process gas compressor.

14. The combined thermodynamic system of claim 12, wherein the power generation circuit is mechanically coupled to the refrigeration circuit via a shaft, and wherein the shaft is configured to transmit the mechanical power produced by the power generation circuit to the refrigerant compressor of the refrigeration circuit.

* * * * *